US011035392B2

(12) United States Patent
Seminel et al.

(10) Patent No.: US 11,035,392 B2
(45) Date of Patent: Jun. 15, 2021

(54) HYDRAULIC ACTUATOR END STROKE STOP PRESSURE/LOAD CONTROL

(71) Applicant: RATIER-FIGEAC SAS, Figeac (FR)

(72) Inventors: Bruno Seminel, Figeac (FR); Patrick Moles, Corn (FR)

(73) Assignee: RATIER-FIGEAC SAS, Figeac (FR)

( * ) Notice: Subject to any disclaimer, the term of this patent is extended or adjusted under 35 U.S.C. 154(b) by 0 days.

(21) Appl. No.: 16/709,397

(22) Filed: Dec. 10, 2019

(65) Prior Publication Data

US 2021/0079932 A1 Mar. 18, 2021

(30) Foreign Application Priority Data

Sep. 12, 2019 (EP) ..... 19290091

(51) Int. Cl.
*F15B 15/22* (2006.01)
*F15B 15/14* (2006.01)

(52) U.S. Cl.
CPC ..... *F15B 15/225* (2013.01); *F15B 15/14* (2013.01)

(58) Field of Classification Search
CPC ..... F15B 13/021; F15B 15/204; F15B 15/225
USPC ..... 91/399, 400, 401
See application file for complete search history.

(56) References Cited

U.S. PATENT DOCUMENTS 2,743,704 A * 5/1956 Banker ..... F15B 15/225 91/410
2,948,263 A * 8/1960 Royer ..... B64C 11/385 91/401
3,613,503 A 10/1971 Phillips
3,998,132 A 12/1976 Rasigade
4,189,983 A * 2/1980 Fassbender ..... F15B 15/225 91/400
4,271,749 A 6/1981 Pease
7,174,828 B2 2/2007 Davies et al.
7,717,025 B2 5/2010 Webster et al.
7,831,352 B2 11/2010 Laumer et al.
8,100,046 B2 * 1/2012 Tunkers ..... F15B 11/022 91/395

(Continued)

FOREIGN PATENT DOCUMENTS

DE 102007036274 A1 2/2009
FR 1125999 A 11/1956
FR 2200451 A1 4/1974

OTHER PUBLICATIONS

European Search Report for Application No. 19290091.8, dated Feb. 24, 2020, 9 pages.

*Primary Examiner* — Michael Leslie
(74) *Attorney, Agent, or Firm* — Cantor Colburn LLP

(57) ABSTRACT

A system for providing pressure/load control at an end stroke stop is provided. The system includes an actuator housing having an end stroke stop and a first actuator housing side, an actuator piston provided in the actuator housing, wherein the actuator piston is movable along a longitudinal axis (A), the actuator piston having a first piston portion perpendicular to the longitudinal axis (A), and means for regulating the pressure/load control at the end stroke stop provided in the first piston portion, wherein the means for regulating the pressure/load control at the end stroke stop is configured to move from a closed position to an open position when in contact with the first actuator housing side.

11 Claims, 3 Drawing Sheets

(56) References Cited

U.S. PATENT DOCUMENTS

| | | | |
|---|---|---|---|
| 8,444,400 | B2 | 5/2013 | Khalil |
| 9,151,303 | B2 | 10/2015 | Jubert et al. |

* cited by examiner

HYDRAULIC ACTUATOR END STROKE STOP PRESSURE/LOAD CONTROL

FOREIGN PRIORITY

This application claims priority to European Patent Application No. 19290091.8 filed Sep. 12, 2019, the entire contents of which is incorporated herein by reference.

TECHNICAL AREA

The present application relates to hydraulic actuator systems. In particular, the present application relates to pressure and/or load control at a hydraulic actuator end stroke stop.

BACKGROUND

Hydraulic actuators usually incorporate end stroke stops between a piston and a cylinder at both ends. In any actuator position, pressure loads in the chamber or chambers is a function of the external load applied to the actuator. Once an actuator piston contacts an end stroke stop, pressure in the chamber that is driving the actuator to the stop usually rises to a maximum system pressure. As an example, an opposite chamber (e.g. in a dual acting actuator system) is usually ported to drain, which means that there is almost no opposite hydraulic pressure load generated by a second actuator chamber.

The above, therefore, results in very high loads on actuator components within an actuator system. This has a significant impact on the fatigue of actuator components when actuator stops are contacted at every operating cycle.

Further, the size of actuator chamber(s) and system pressure is typically set to meet system performances when the load required to maintain the system against an end stroke stop is much lower than the load developed under full system pressure. This is the case, for example, in propeller pitch change actuators where the load required to maintain the blades in feather position is very small compared to the maximum load generated by blades in flight. This leads to oversizing of actuator components.

SUMMARY

In one example, there is described a system for providing pressure/load control at an end stroke stop. The system includes an actuator housing having an end stroke stop and a first actuator housing side, an actuator piston provided in the actuator housing, wherein the actuator piston is movable along a longitudinal axis, the actuator piston having a first piston portion perpendicular to the longitudinal axis, and means for regulating the pressure/load control at the end stroke stop provided in the first piston portion, wherein the means for regulating the pressure/load control at the end stroke stop is configured to move from a closed position to an open position when in contact with the first actuator housing side.

The first piston portion may have an opening that extends through a first piston portion side to a second piston portion side. The means for regulating the pressure/load control at the end stroke stop may be provided within the opening.

The means for regulating the pressure/load control at the end stroke stop may further include a ball bearing, a first biasing spring, a rod, a valve assembly casing. When the valve assembly casing contacts the first actuator housing side, in use, the rod may move to contact the ball bearing such that the means for regulating the pressure/load control at the first actuator housing side provides fluid flow through the opening.

The means for regulating the pressure/load control may further include a valve piston and a second biasing spring, wherein, a first force, P1×A1, where P1 is a first pressure and A1 is the area of the valve piston, is exerted through the opening and on a first side of the valve piston, and wherein a second force, P2×A2+S, where P2 is a second pressure, A2 is the area of the valve piston and S is the force exerted by the second biasing spring, is exerted on a second side of the valve piston. When P1×A1 is greater than P2×A2+S, the valve piston may move such that pressure can be discharged through at least one passageway provided in the valve piston.

In an alternative example to the valve piston, there may be provided an orifice between the ball bearing and the second piston portion side. There may be provided a restriction in the orifice such that the restriction provides a pressure drop to regulate the pressure of the fluid through the opening.

In another example, there is described a method for providing pressure/load control at an end stroke stop. The method may include providing an actuator housing having an end stroke stop and a first actuator housing side, providing an actuator piston provided in the actuator housing, wherein the actuator piston is movable along a longitudinal axis, the actuator piston having a first piston portion perpendicular to the longitudinal axis, and providing means for regulating the pressure/load control at the end stroke stop provided in the first piston portion, wherein the means for regulating the pressure/load control at the end stroke stop is configured to move from a closed position to an open position when in contact with the first actuator housing side.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
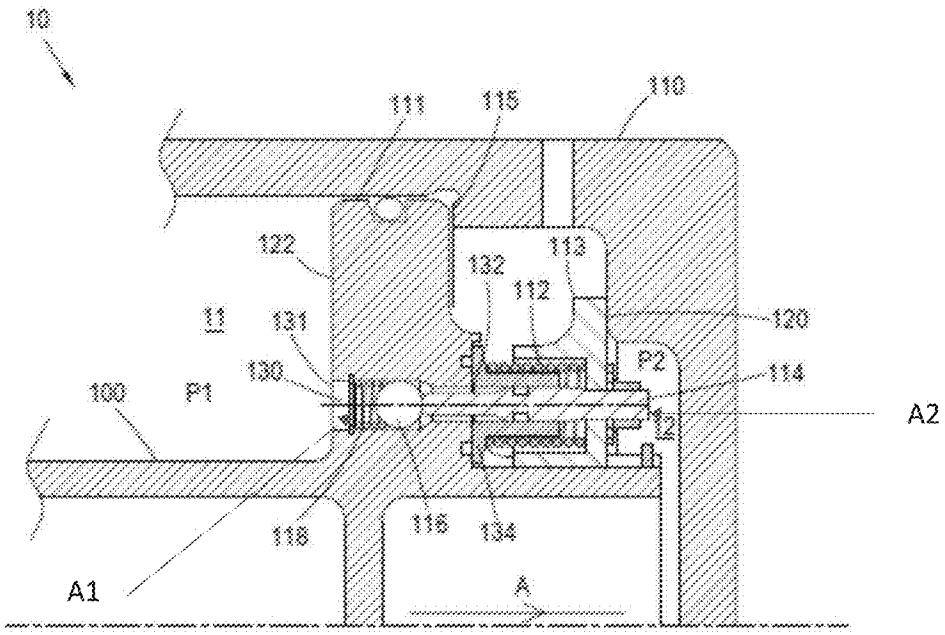
FIG. 1 shows an example of an assembly that provides pressure/load control at an end stroke stop.
Figure 2:
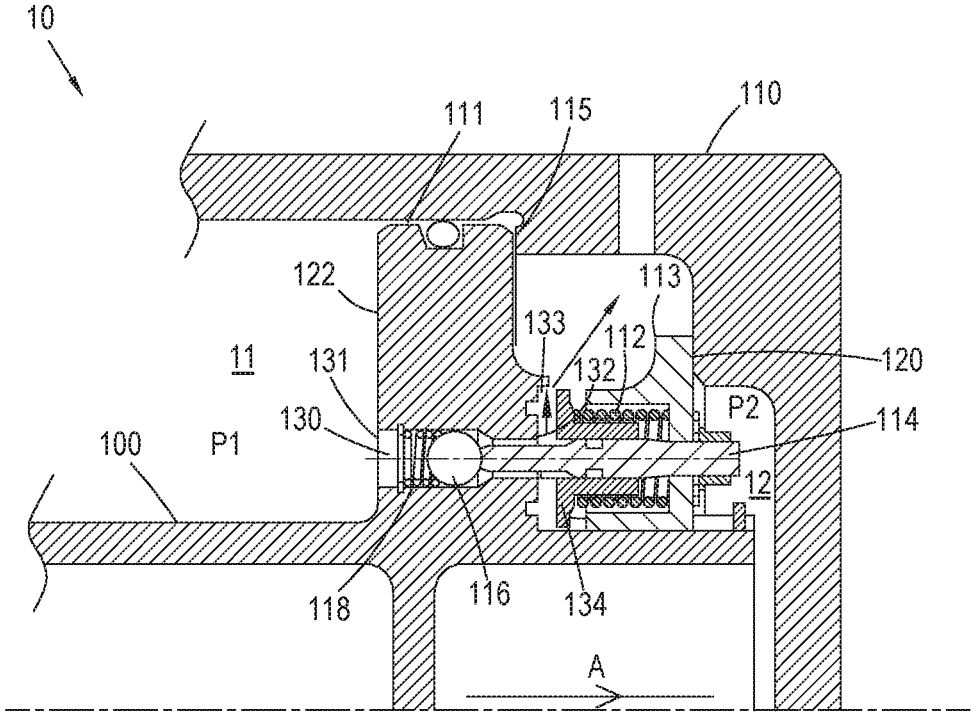
FIG. 2 shows an example of the assembly of FIG. 1 when the assembly is in an open position.

With reference to FIGS. 1 and 2, there is shown, generally, an actuator assembly 10. The actuator assembly 10 may include an actuator housing 110 for housing an actuator piston 100 that can slidably move within the actuator housing 110 along an axis A. The actuator piston 100 may include an end stroke stop valve assembly to control pressure/load when the actuator piston 100 contacts an end stroke stop 115 of the actuator housing 110.

The end stroke stop valve assembly may be provided within and/or on the actuator piston 100, as shown in FIG. 1. The actuator piston 100 may include a first piston portion 122 that extends perpendicular from the axis A to a first inner surface 111 of the actuator housing 110. As can be seen in FIG. 1, there may be provided an opening 130 that extends from a first piston portion side 131 to a second piston portion side 132 through the first piston portion 122 along axis A. Within the opening 130, there may be provided a first biasing spring 118 and a ball bearing 116. The ball bearing 116 may be contacted by a rod 114 that may extend out of the opening 130 of the first piston portion 122 and in to a valve assembly casing 113. The rod 114 may be fixed to the valve assembly casing 113, and the rod 114 may be slidably received within the opening 130 through the second piston portion side 132 to contact the ball bearing 116. There may also be provided in the end stroke stop valve assembly a valve piston 134 that may be connected to the valve assembly casing 113 by a second biasing spring 112. The valve piston 134 may move from a closed position to an open position in response to a pressure differential across the end stroke stop valve assembly.

The actuator housing 110 includes a first actuator housing side 120, as shown in FIG. 1. When the actuator piston 100 moves to the first actuator housing side 120, the valve assembly casing 113 contacts the first actuator housing side 120. The force exerted on to the valve assembly casing 113 from the first actuator housing side 120 allows the valve assembly casing 113 to move in an opposite direction to the actuator piston 100 such that the rod 114 moves to contact and move the ball bearing 116 into an open position. Opening the ball bearing 116 allows for fluid communication through the end stroke stop valve assembly. When the actuator piston 100 moves away from the first actuator housing side 120, the first biasing spring 118 acts to restore the position of the rod 114 such that the ball bearing 116 moves to a closed position and prevents any flow communication between a first chamber 11 and a second chamber 12. Biasing spring 118 force is set to prevent any 116 opening under any delta pressure between the first chamber 11 and the second chamber 12.

When the actuator piston 100 moves to the first actuator housing side 120, and the ball bearing 116 is in an open position, the valve piston 134 is able to move in response to pressure on either side of the end stroke stop valve assembly. The second biasing spring 112 is provided to the valve piston 134 and a pressure threshold is set in the end stroke stop valve assembly by increasing or decreasing the compressive force of the second biasing spring. The pressure exerted on the left hand side of the valve piston 134 in the first actuator chamber 11, e.g. fluid flow through the opening 130, may be denoted as P1. When the actuator piston 100 contacts the end stroke stop 115, P1 increases over time. The force exerted on the left side of the valve piston 134 may be denoted as P1×A1; A1 being the area of the valve piston 134 subject to pressure P1. The force exerted on the right hand side of the valve piston 134 may be denoted as P2×A2+S, where S is the force of the biasing spring, A2 is the area of the piston 134 subject to pressure P2 and P2 is the pressure in the second actuator chamber 12 on the right side of the valve piston 134. As P1 increases, and becomes high enough such that P1×A1>P2×A2+S, the valve piston 134 moves against the second biasing spring 112 to move to open a passage for fluid flow (shown in FIG. 2). The larger the flow, the larger the movement of piston 134 will be. This acts to regulate P1 pressure to the required range. This range can be adjusted via biasing spring 112 preload and spring rate.

FIG. 2 shows an example of the valve piston 134 when in an opened position. As can be seen in this figure, the actuator assembly 10 comprises all the components as described above in relation to FIG. 1. When the valve assembly casing 113 contacts the end stroke stop 120, the valve assembly casing 113 moves in an opposite direction to the actuator piston 100 such that the rod 114 moves to contact and move the ball bearing 116 into an open position. Fluid is then able to flow through the opening 130 and around the ball to exert a pressure (e.g. P1×A1) on the valve piston 134. As mentioned above, the force exerted on the opposite side of the valve piston 134 is denoted by P2×A2+S. As P1×A1 gradually increases and becomes high enough such that P1×A1>P2×A2+S, the valve piston 134 may move in a direction against the force exerted from the second biasing spring 112 to move to an open position. At this point, at least one passageway 133 is revealed in the valve piston 134 to provide a fluid communication with the fluid that has moved through opening 130. The passageway 133 therefore allows fluid to flow in order to bring P1×A1 to a target level. As shown in FIG. 2, the at least one fluid passageway 133 extends through the valve piston 134 in a direction perpendicular to the axis A. It is envisaged that the force P2×A2+S can be altered by changing the tensile stress or the biasing spring rate (e.g. stiffness) of the second biasing spring 112.

Figure 3:
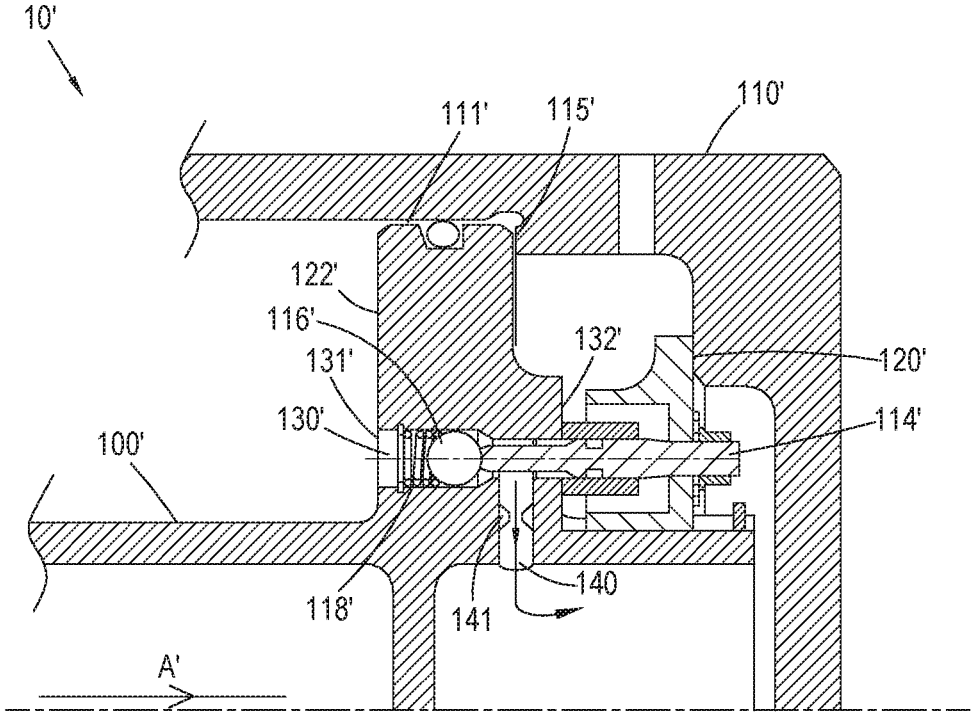
FIG. 3 shows an alternative example of an assembly that provides pressure/load control at an end stroke stop.

FIG. 3 shows an alternative example of the actuator assembly 10 of FIG. 1. The components in this Figure are denoted by a " " to show like-for-like components of FIGS. 1 and 2.

In FIG. 3, the actuator assembly 10' may include an actuator housing 110' for housing an actuator piston 100' that can slidably move within the actuator housing 110' along an axis A'. The actuator piston 100' may include an end stroke stop valve assembly to control pressure/load when the actuator piston 100' contacts an end stroke stop 115' of the actuator housing 110'.

The end stroke stop valve assembly may be provided within and/or on the actuator piston 100', as shown in FIG. 3. The actuator piston 100' may include a first piston portion 122' that extends perpendicular from the axis A' to a first inner surface 111' of the actuator housing 110. As can be seen in FIG. 1, there may be provided an opening 130' that extends from a first piston portion side 131' to a second piston portion side 132' through the first piston portion 122' along axis A'. Within the opening 130', there may be provided a first biasing spring 118' and a ball bearing 116'. The ball bearing 116' may be contacted by a rod 114' that may extend out of the opening 130' of the first piston portion 122' and in to a valve assembly casing 113'. The rod 114' may be fixed to the valve assembly casing 113', and the rod 114' may be slidably received within the opening 130' through the second piston portion side 132' to contact the ball bearing 116'.

In the example shown in FIG. 3, there may be provided an orifice 140 that is located in the first piston portion 122' between the ball bearing 116' and the second piston portion side 132'. The orifice 140 is shown in FIG. 3 as extending in a perpendicular direction to axis A'. The orifice 140 may include a restriction 141 that acts to generate a pressure drop—for example, pressure upstream of the restriction 141 may be greater than pressure downstream of the restriction 141. In this way, the pressure of the fluid flow through the opening 130' may not exceed a target value due to the size of the restriction 141. The target value may be altered by reducing or increasing the size of the restriction 141.

Although the invention has been described in terms of preferred examples as set forth above, it should be understood that these examples are illustrative only and that the claims are not limited to those examples. Those skilled in the art will be able to make modifications and alternatives in view of the disclosure which are contemplated as falling within the scope of the appended claims. In an example, the system described above can be used at the other actuator end end-stroke stop. Also, it is envisaged that the valve assembly could be installed in the housing with adequate connections via plumbing instead of in the piston 110.

What is claimed is:

1. A system for providing pressure/load control at an end stroke stop, the system comprising:

an actuator housing having an end stroke stop and a first actuator housing side;

an actuator piston provided in the actuator housing, wherein the actuator piston is movable along a longitudinal axis (A), the actuator piston having a first piston portion perpendicular to the longitudinal axis (A); and means for regulating the pressure/load control at the end stroke stop provided in the first piston portion, wherein the means for regulating the pressure/load control at the end stroke stop is configured to move from a closed position to an open position when in contact with the first actuator housing side;

wherein the first piston portion has an opening that extends through a first piston portion side to a second piston portion side;

wherein the means for regulating the pressure/load control at the end stroke stop comprises:

a ball bearing, a first biasing spring, a rod, a valve assembly casing, wherein, when the valve assembly casing contacts the first actuator housing side, in use, the rod is configured to move to contact the ball bearing such that the means for regulating the pressure/load control at the end stroke stop provides fluid flow through the opening.

2. The system of claim 1, wherein the means for regulating the pressure/load control at the end stroke stop is provided within the opening.

3. The system of claim 1, wherein the means for regulating the pressure/load control includes: a valve piston; and a second biasing spring;

wherein, a first force, $P1 \times A1$, where P1 is a first pressure and A1 is the area of the valve piston, is exerted through the opening and on a first side of the valve piston, and wherein a second force, $P2 \times A2 + S$, where P2 is a second pressure, A2 is the area of the valve piston and S is the force exerted by the second biasing spring, is exerted on a second side of the valve piston.

4. The system of claim 3, wherein, when $P1 \times A1$ is greater than $P2 \times A2 + S$, the valve piston is configured to move such that pressure can be discharged through at least one passageway provided in the valve piston.

5. The system of claim 1, wherein there is provided an orifice between the ball bearing and the second piston portion side.

6. The system of claim 5, wherein there is provided a restriction in the orifice such that the restriction provides a pressure drop to regulate the pressure of the fluid through the opening.

7. A method for providing pressure/load control at an end stroke stop, the method comprising:

providing an actuator housing having an end stroke stop and a first actuator housing side;

providing an actuator piston provided in the actuator housing, wherein the actuator piston is movable along a longitudinal axis (A), the actuator piston having a first piston portion perpendicular to the longitudinal axis;

providing means for regulating the pressure/load control at the end stroke stop provided in the first piston portion, wherein the means for regulating the pressure/load control at the end stroke stop is configured to move from a closed position to an open position when in contact with the first actuator housing side;

wherein the first piston portion has an opening that extends through a first piston portion side to a second piston portion side, and wherein the means for regulating the pressure/load control at the end stroke stop is provided within the opening;

wherein the means for regulating the pressure/load control at the end stroke stop comprises:

a ball bearing, a first biasing spring, a rod, a valve assembly casing, wherein, when the valve assembly casing contacts the first actuator housing side, in use, the rod is configured to move to contact the ball bearing such that the means for regulating the pressure/load control at the end stroke stop provides fluid flow through the opening.

8. The method of claim 7, wherein the means for regulating the pressure/load control at the end stroke stop includes a valve piston and a second biasing spring, wherein, a first force, $P1 \times A1$, where P1 is a first pressure and A1 is the area of the valve piston, is exerted through the opening and on a first side of the valve piston, and wherein a second force, $P2 \times A2 + S$, where P2 is a second pressure, A2 is the area of the valve piston and S is the force exerted by the second biasing spring, is exerted on a second side of the valve piston.

9. The method of claim 8, wherein, when $P1 \times A1$ is greater than $P2 \times A2 + S$, the valve piston is configured to move such that pressure can be discharged through at least one passageway provided in the valve piston.

10. The method of claim 7, wherein there is provided an orifice between the ball bearing and the second piston portion side.

11. The method of claim 10, wherein there is provided a restriction in the orifice such that the restriction provides a pressure drop to regulate the pressure of the fluid through the opening.

* * * * *